US011613136B2

(12) United States Patent
Saga

(10) Patent No.: US 11,613,136 B2
(45) Date of Patent: Mar. 28, 2023

(54) THERMAL PRINTER

(71) Applicant: TOSHIBA TEC KABUSHIKI KAISHA, Tokyo (JP)

(72) Inventor: Kengo Saga, Mishima Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 82 days.

(21) Appl. No.: 17/202,239

(22) Filed: Mar. 15, 2021

(65) Prior Publication Data

US 2021/0402811 A1 Dec. 30, 2021

(30) Foreign Application Priority Data

Jun. 24, 2020 (JP) ..... JP2020-108983

(51) Int. Cl.
*B41J 13/00* (2006.01)
*B41J 2/32* (2006.01)

(52) U.S. Cl.
CPC ..... *B41J 13/0009* (2013.01); *B41J 2/32* (2013.01)

(58) Field of Classification Search
CPC ..... B41J 13/0009; B41J 15/042; B41J 2/32; B41J 11/425; B41J 13/00; B41J 15/00; B41J 15/04; B41J 15/046
See application file for complete search history.

(56) References Cited

U.S. PATENT DOCUMENTS 6,518,992 B1 2/2003 Jimbo
2017/0282618 A1* 10/2017 Hata ..... B41J 29/38

* cited by examiner

*Primary Examiner* — Kristal Feggins
(74) *Attorney, Agent, or Firm* — Kim & Stewart LLP

(57) ABSTRACT

A thermal printer includes a conveyance unit, a thermal head with heating elements arranged in a line crossing a conveyance direction of a thermal paper, and a controller that generates print dot data for dots to be printed by the thermal head and controls the conveyance unit and thermal head according to the print dot data. The controller determines whether the total number of dots to be printed in a predetermined number of consecutive lines of the print dot data is greater than a threshold number and, when the total number of dots is greater than the threshold number, control the conveyance unit to convey the thermal paper after the printing of the print dot data by a predetermined amount along the conveyance direction.

18 Claims, 6 Drawing Sheets

| Additional Feed | Feed Flag |
|---|---|
| Present Job | 1 |
| Prior Job | 0 |

THERMAL PRINTER

CROSS-REFERENCE TO RELATED APPLICATIONS

This application is based upon and claims the benefit of priority from Japanese Patent Application No. 2020-108983, filed on Jun. 24, 2020, the entire contents of which are incorporated herein by reference.

FIELD

Embodiments described herein relate generally to a thermal printer, a printing method carried out by a thermal printer, and a non-transitory computer readable medium.

BACKGROUND

In the related art, there is a thermal printer that prints characters or the like on thermal paper using a linear thermal head including a plurality of heating elements arranged along a line intersecting with a paper conveyance direction. The thermal printer performs printing by applying heat to the thermal paper from the heating elements to cause the thermal layer of the thermal paper to develop color. If the amount of heat generated by the heating elements is large, the surface of the thermal paper may melt from the heat, causing a poor image or the like.

In the thermal printer described above, when the thermal head stays at the print position on the thermal paper after printing, the surface of the melted thermal paper will eventually be cooled and solidified, which may cause sticking between the thermal paper and the heating elements of the thermal head (this may also be referred to as sticking between the thermal head and the thermal paper). Such sticking typically occurs when the number of active heating elements is large and the amount of heat applied to the thermal paper is large. That is, when the number of printed dots is large (corresponding to a large number of active heating elements), sticking is more likely to occur. When sticking between the thermal head and the thermal paper occurs, unevenness occurs in conveyance of the thermal paper and print quality deteriorates.

As a device for preventing sticking between the thermal head and the thermal paper, there is a device having a divided line thermal head which is useful for preventing the sticking from occurring. More specifically, the line thermal head having heating elements arranged along one line is divided into a plurality of blocks, and each block is heated separately so as to prevent the sticking between a block and the thermal paper, which occurs after the printing of one line is completed.

However, in the above-described related art, it is still not possible to avoid sticking that occurs when the thermal head continues to stay at the print position after the printing.

For example, in a printer that prints a receipt ("a receipt printer"), when the receipt is to have additional information such as a store logo or an advertisement printed above transaction information at the top of the receipt, such additional information for the receipt to be issued next may be printed in advance before the next transaction information is even ready to be printed. In such a case, the thermal head dwells at the print position where the additional information was printed until the next receipt is printed, and thus the thermal head and the thermal paper may stick to each other depending on the amount of heat generated during the printing of the additional information. In addition, depending on how the thermal printer is being used, there is a case that the thermal head stays at the print position after printing of the print data is completed and waits there until the next print data is required to be printed. For this reason, it is desired to suppress sticking between the thermal head and the thermal paper that occurs after the printing of the print data.

DETAILED DESCRIPTION

In general, according to one embodiment, a thermal printer, includes a conveyance unit configured to convey a thermal paper, a thermal head including a plurality of heating elements arranged along a line crossing a conveyance direction of the thermal paper, and a controller. The controller is configured to generate print dot data indicating one or more dots to be printed in each line of a print data, control the conveyance unit and the thermal head to print on the thermal paper according to the print dot data, determine whether a total number of dots to be printed in a predetermined number of consecutive lines including a last line of the print dot data is greater than or equal to a threshold number, and, when the total number of dots is greater than or equal to the threshold number, control the conveyance unit to convey the thermal paper by a predetermined amount along the conveyance direction after printing of the print dot data is performed.

Hereinafter, a thermal printer according to certain example embodiments will be described with reference to the drawings.

Figure 1:
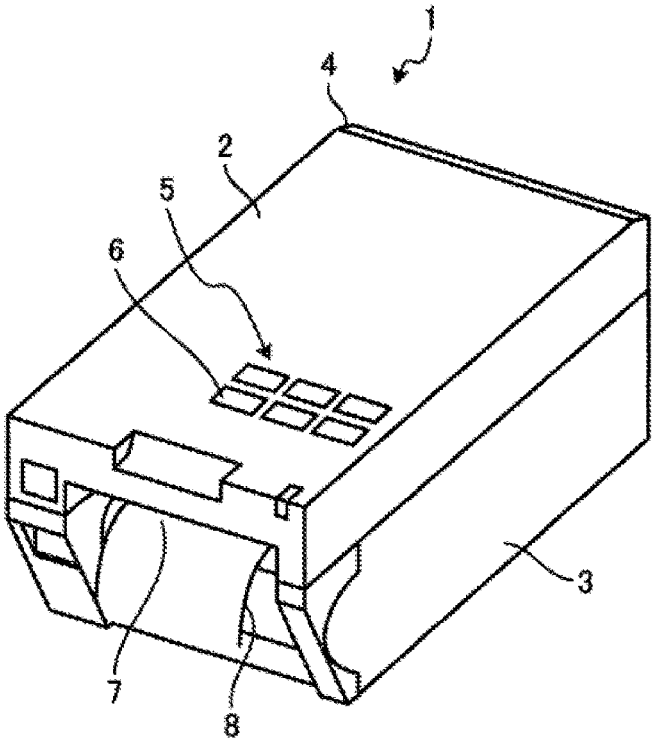
FIG. 1 is a perspective view showing a thermal printer according to an embodiment.

FIG. 1 is a perspective view showing a thermal printer 1. The thermal printer 1 is connected to a host device (e.g., a POS (Point Of Sales) terminal) and configured to receive transaction information, store logo information, advertisement information, and the like from the POS terminal. Such information may be referred to as print data. In the present example, thermal printer 1 is a receipt printer for the POS terminal. However, the thermal printer 1 may be used for other purposes or functions in other examples. The thermal printer 1 may acquire the print data by any method.

The thermal printer 1 includes an upper housing 2 and a lower housing 3. The upper housing 2 is rotatably attached (e.g., hinged) to the lower housing 3 so as to rotate about one end side 4. When the upper housing 2 is rotated from the state shown in FIG. 1, the inside of the thermal printer 1 can be seen. An operation unit 5 is provided on the upper surface of the upper housing 2. The operation unit 5 includes a plurality of input operation buttons 6. The operation unit 5 accepts inputs of various instructions to the thermal printer 1 including turning a power supply on and off. The thermal printer 1 also has an issue port 7. The issue port 7 discharges a printed receipt 8 from the thermal printer 1 to the outside.

Figure 2:
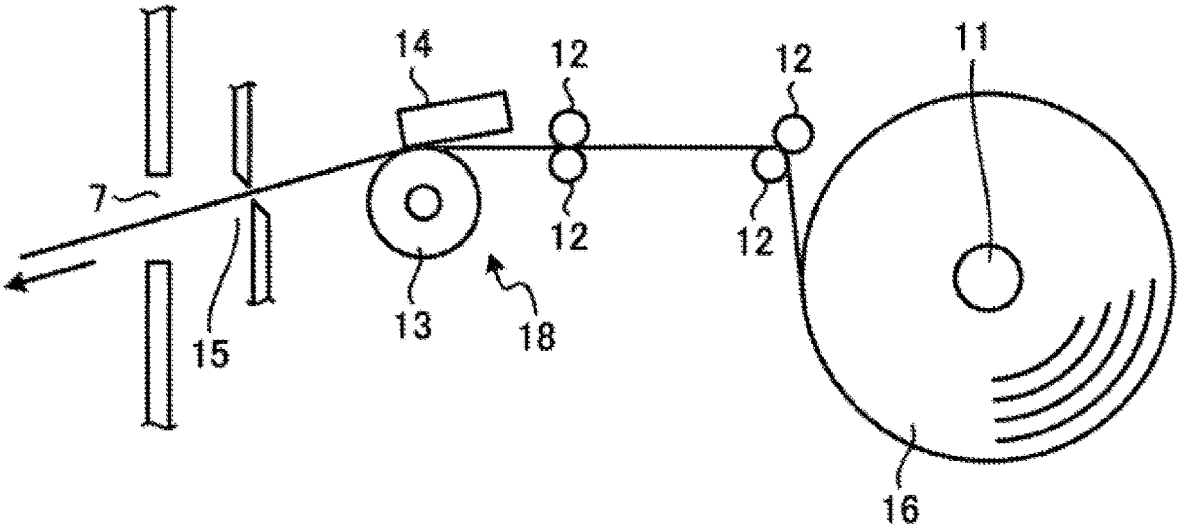
FIG. 2 is a schematic diagram illustrating an internal configuration of a thermal printer according to an embodiment.

FIG. 2 illustrates an internal structure of the thermal printer 1. As shown in FIG. 2, the thermal printer 1 includes therein a holding unit 11, a plurality of guide rollers 12, a platen roller 13, a thermal head 14, a cutter 15 including a pair of blades, and the like.

The holding unit 11 rotatably holds the thermal paper 16 wound in a roll shape. The guide rollers 12 guide the thermal paper 16 that is unwound from the holding unit 11 to pass between the platen roller 13 and the thermal head 14. Two pairs of the guide rollers 12 are provided along the conveyance path between the holding unit 11 to between the platen roller 13 and the thermal head 14.

The platen roller 13 is rotated by a conveyance motor 17 (see FIG. 3) to pass the thermal paper 16 between the platen roller 13 and the thermal head 14. The conveyance motor 17 is, for example, a stepping motor. The platen roller 13 and the conveyance motor 17 make up a conveyance unit 18 that conveys the thermal paper 16. Conveyance of the thermal paper 16 by the conveyance unit 18 in the direction of the arrow (hereinafter referred to as the conveyance direction) in FIG. 2 toward the issue port 7 may be referred to as feed, and conveyance in the opposite direction may be referred to as back or backward feed.

The thermal head 14 is a linear thermal head in which a plurality of heating elements are provided along a line intersecting (perpendicular in the present embodiment) the conveyance direction of the thermal paper 16. In FIG. 2, the linear thermal head extends in a direction orthogonal to the page surface. The thermal head 14 is urged (pressed) toward the platen roller 13 with a predetermined pressure. The thermal head 14 performs printing on the thermal paper 16 conveyed by the conveyance unit 18 by selectively heating the heating elements and applying thermal energy to the thermal paper 16 according to print data or the like.

The cutter 15 has a flat plate-shaped fixed blade and a movable blade having substantially the same shape, and is capable of cutting the thermal paper 16 at any position along the length of the thermal paper 16 by sliding the movable blade with respect to the fixed blade. In FIG. 2, the fixed blade is disposed on the upper side in the drawing, and the movable blade is disposed on the lower side in the drawing. The movable blade is driven by a cutter motor 19 (see FIG. 3) to be move upward and downward along the vertical direction page in FIG. 2. The movable blade is positioned at a lower position to let the thermal paper 16 pass (uncut) between the movable blade and the fixed blade, and then moves upward when the thermal paper 16 is to be cut to complete the receipt or the like. The thermal paper 16 cut by the cutter 15 is then issued from the issue port 7 as the receipt 8.

Figure 3:
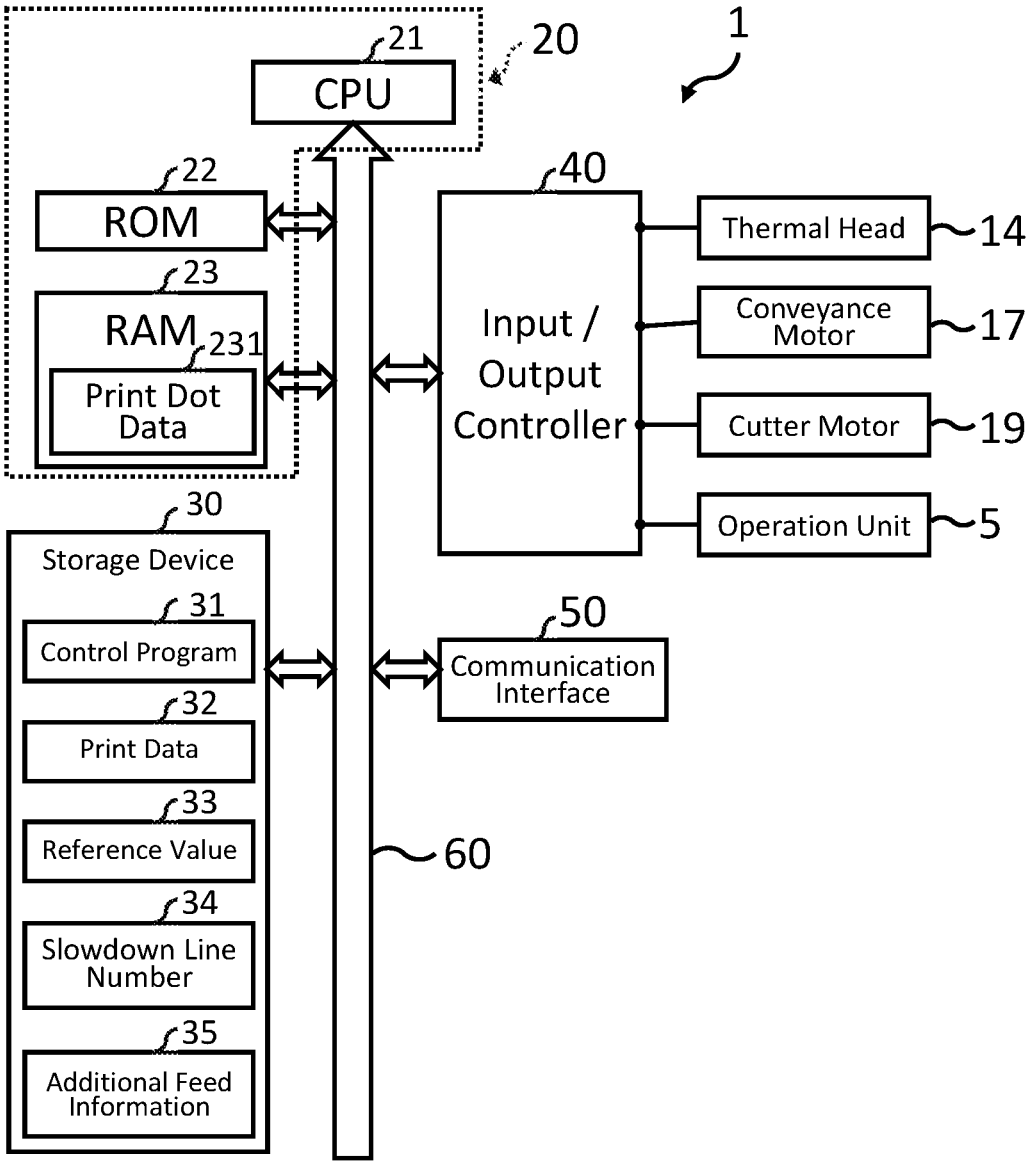
FIG. 3 is a hardware block diagram showing a thermal printer according to an embodiment.

Next, a hardware configuration of the thermal printer 1 will be described. FIG. 3 is a hardware block diagram of the thermal printer 1. The thermal printer 1 includes a controller 20, a storage device 30, an input/output controller 40, and a communication interface (I/F) 50. The controller 20, the storage device 30, the input/output controller 40, and the communication I/F 50 are connected to each other via a bus 60.

The controller 20 includes a CPU (Central Processing Unit) 21, a ROM (Read Only Memory) 22, and a RAM (Random Access Memory) 23. CPU 21, ROM 22, and RAM 23 are connected to each other via the bus 60.

The CPU 21 controls the overall operation of the thermal printer 1. The ROM 22 stores various programs such as a program executed by the CPU 21. The RAM 23 stores print dot data 231. The print dot data 231 is generated based on print data received from the POS terminal. The print dot data indicates images and characters to be printed by the thermal head 14 as a collection of dots. The print dot data is obtained by converting print data received from POS terminal. For example, the print dot data has a bitmap format. The print dot data includes a print dot data for each line. That is, the print dot data is an aggregate of print dot data for each line to be printed. That is, print dot data is provided on a line-by-line basis, such that the particular dots printed on each line can change line to line. The RAM 23 is used as a work area of the CPU 21, and temporarily stores various programs and various data copied from the ROM 22 or the storage device 30. The CPU 21 of the controller 20 executes various control processes of the thermal printer 1 in accordance with a control program(s) stored in the ROM 22 or the storage device 30 and copied to the RAM 23.

The storage device 30 includes, for example, an HDD (Hard Disk Drive) or an SSD (Solid State Drive). The storage device 30 includes a control program section 31, a print data section 32, a reference value section 33, a slowdown line number section 34, and an additional feed information section 35. The control program section 31 stores various control programs in addition to a control program necessary to execute functions as the thermal printer 1.

The print data section 32 stores print data acquired from the POS terminal. Specifically, the print data section 32 stores code information corresponding to characters, graphics, and the like received together with a print instruction (hereinafter also referred to as issuance instruction) from the POS terminal.

The reference value section 33 stores a reference value (or a threshold value) to be compared with the number of print dots to be printed by the heating elements. The number of print dots are indicated by the print dot data 231 stored in the RAM 23. The reference value is the number of dots at which the thermal head 14 and the thermal paper 16 are highly likely to stick to each other after the end of printing if the number of dots to be printed is greater than or equals to the reference value. The reference value is set in advance at the time of product shipment in consideration of the amount of heat generated by the heating elements of the thermal head 14 at the time of printing. However, the user of the thermal printer 1 can manually change the reference value by operating the operation unit 5.

The slowdown line number section 34 stores the number of lines (the "slowdown line number") for which the conveyance motor 17 is to be decelerated in the final stage of printing of the print data. For example, the slowdown line number is four, but any number of lines can be set.

Figures 4, 5:
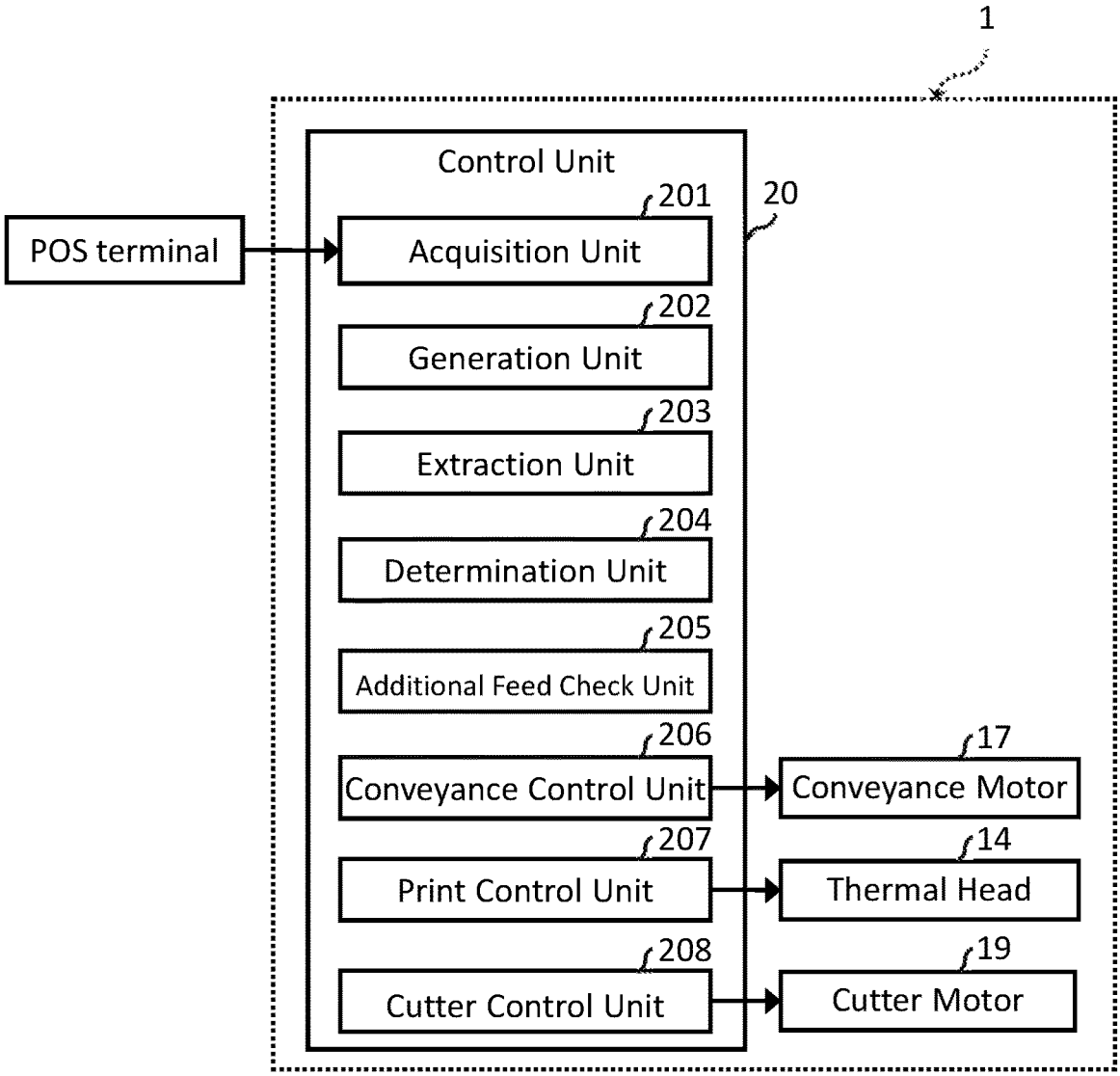
FIG. 4 is a diagram showing a data structure of additional feed information.
FIG. 5 is a functional block diagram showing a thermal printer according to an embodiment.

The additional feed information section 35 stores information indicating whether an additional feed (to be described further later) is to be performed after the print data has been printed. FIG. 4 is a diagram showing the additional feed information section 35. The additional feed information section 35 stores a value of "1" in the additional feed flag column when an additional feed is to be performed, and "0" when an additional feed is not to be performed. The additional feed information section 35 is rewritten every time printing is performed.

The input/output controller 40 is connected to the thermal head 14, the conveyance motor 17, the cutter motor 19, and the operation unit 5. The input/output controller 40 is an input/output interface circuit for controlling the connected hardware. Thus, the controller 20 can transmit and receive information or data to and from the thermal head 14, the conveyance motor 17, the cutter motor 19, and the operation unit 5 via the input/output controller 40, and can control these hardware components based on instructions from the controller 20. The communication I/F 50 is an interface circuit for communicating with the POS terminal that is a host device.

Next, a functional configuration of the thermal printer 1 will be described. FIG. 5 is a block diagram illustrating an example of a functional configuration of the thermal printer 1. The controller 20 executes the control program(s) stored in the storage device 30 and functions as an acquisition unit 201, a generation unit 202, an extraction unit 203, a determination unit 204, an additional feed check unit 205, a conveyance control unit 206, a print control unit 207, and a cutter control unit 208. These functions may be implemented by hardware or dedicated circuits.

The acquisition unit 201 acquires print data from the POS terminal. Specifically, the acquisition unit 201 receives code information indicating characters, graphics, and the like together with information indicating an instruction to issue a receipt from the POS terminal via the communication I/F 50, and stores the code information in the RAM 23. The acquisition unit 201 may acquire data in a bitmap format or the like.

The generation unit 202 generates print dot data for each line based on the print data acquired by the acquisition unit 201. Specifically, the generation unit 202 reads the print data stored in the RAM 23, generates data in a bitmap format by using, for example, a character generator, and store the generated data as the print dot data 231. When the print data received by the acquisition unit 201 from the POS terminal and stored in the RAM 23 is print dot data representing an image to be printed by as a collection of dots, such as in a bitmap format, the generation unit 202 simply stores the print dot data in the RAM 23.

The extraction unit 203 extracts the number of print dots in a predetermined number of lines including the last line from the print dot data generated by the generation unit 202. The number of print dots corresponds to the number of heating elements of the thermal head 14 that generate heat during printing. For example, the extraction unit 203 extracts the number of dots to be printed in the last four lines in the printing of the data from the print dot data section 231. In other words, the number of heating elements that are caused to generate heat for the last four lines of print data is extracted. In an embodiment, the predetermined number of lines is set to four lines, but is not limited thereto. The predetermined number of lines can be appropriately set according to the type of thermal paper 16 and the thermal head 14 to be used.

The determination unit 204 determines whether the number of print dots for a predetermined number of lines is equal to or greater than the reference value (from reference value section 33). Specifically, the determination unit 204 determines whether the number of dots extracted by the extraction unit 203 is equal to or greater than the reference value stored in the storage device 30. The determination unit 204 sets the feed flag for the present job in the additional feed information section 35 based on the determination result.

When printing is performed, the additional feed check unit 205 refers to the feed flag stored in the additional feed information section 35 for the present job and also checks whether an additional feed was performed in the previous printing (e.g., for the most recent prior job).

The conveyance control unit 206 controls conveyance of the thermal paper 16. Specifically, the conveyance control unit 206 controls the conveyance unit 18 to convey the thermal paper 16 by one line for printing the next line after printing one line by the thermal head 14 at the time of printing the print data. Further, the conveyance control unit 206 may switch the conveyance method of the thermal paper 16 as the last line of the print dot data approaches according to the value of the feed flag for the present printing.

For example, when the determination unit 204 determines that the number of dots extracted by the extraction unit 203 is less than the reference value 33, that is, when the feed flag is "0", the conveyance control unit 206 gradually reduces the conveyance speed for the last few lines or so to slow down the conveying of the thermal paper 16 (hereinafter also referred to as a conveyance slowdown or a feed slowdown). In an embodiment, paper conveyance is slowed down for the last four lines (based on the setting value in the slowdown line number section 34) of the print dot data.

When the determination unit 204 determines that the number of dots extracted by the extraction unit 203 is equal to or greater than the reference value, that is, when the feed flag is set "1" for the present job, the conveyance control unit 206 controls the conveyance unit 18 to additionally feed the thermal paper 16 by a predetermined amount after the last line of the print dot data has been printed. The conveyance control unit 206 then performs a slowdown in which the conveyance speed is gradually reduced while an additional feed is being performed after the completion of the las line of print dot data. In an embodiment, the extra conveyance amount to be additionally fed is set to the same value as the setting value (e.g., four lines) of the slowdown line number section 34, but is not limited thereto.

In addition, if an additional feed is performed for one job, then for the next job, the conveyance control unit 206 controls the conveyance unit 18 to feed back the thermal paper 16 by the predetermined amount before starting of the next printing (first line of print dot data). The conveyance control unit 206 not only controls the conveyance unit 18 as described above, but also controls the conveyance unit 18 according to instructions from the operation unit 5 or the like to appropriately convey the thermal paper 16.

The print control unit 207 controls the thermal head 14 based on the print dot data for each line generated by the generation unit 202. Under the control of the print control unit 207, desired (selected) heating elements of the thermal head 14 generate heat to perform the printing on the thermal paper 16.

The cutter control unit 208 controls the cutter motor 19 to cut the thermal paper 16. More specifically, when the thermal head 14 finishes printing on the thermal paper 16, the cutter control unit 208 drives the cutter motor 19. The cutter motor 19 moves the movable blade of the cutter 15 to cut the thermal paper 16. The cut thermal paper 16 is issued as a receipt 8 from the issue port 7.

Figure 6:
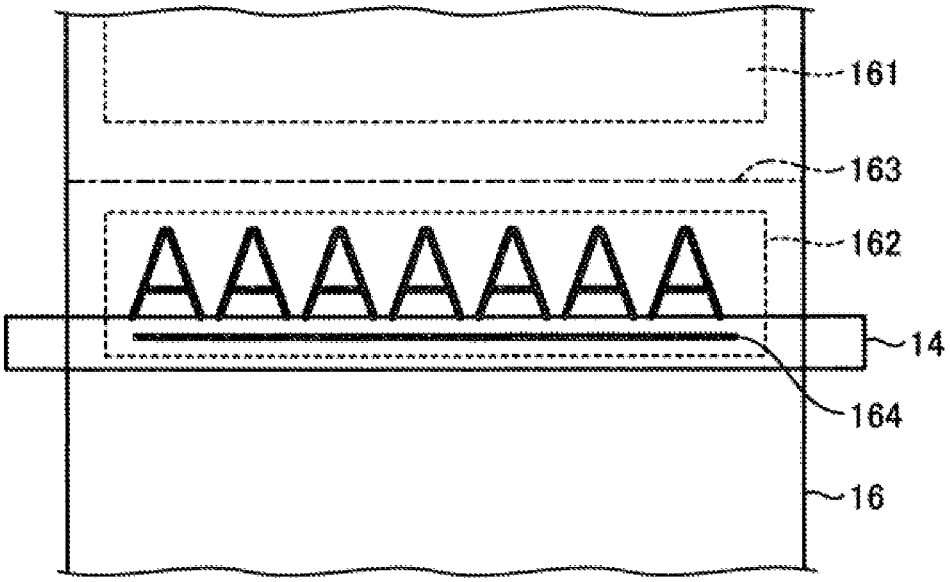
FIG. 6 is a diagram showing a positional relationship between a thermal head and a thermal paper after printing by a thermal printer according to an embodiment.

Next, an outline of the printing operation of the thermal printer 1 will be described with reference to FIGS. 6 to 9. FIG. 6 is a diagram showing the positional relationship between the thermal head 14 and the thermal paper 16 after printing. The print data transmitted together with the print instruction from the POS terminal includes, for example, data related to transaction information and data related to additional image or character information such as a store logo and an advertisement.

When receiving print data from a POS terminal, a thermal printer 1 prints transaction information in a transaction information area 161 and then prints additional information in an additional information area 162. Thereafter, the cutter 15 cuts the thermal paper 16 along the cutting line 163 so that the portion located above the cutting line 163 in FIG. 6 is discharged as the receipt 8 from the issue port 7. On the other hand, the additional information printed in the additional information area 162 stays in the thermal printer 1. That is, the data relating to the transaction information received from the POS terminal is printed on the receipt 8 issued based on the current print instruction, and the data relating to the additional information is printed on the receipt issued based on the next print instruction. The cutting of the thermal paper 16 by the cutter 15 may be performed after the printing of the transaction information and before the printing of the additional information.

After printing, the heating elements of the thermal head 14 are positioned on the final printing line. In the example shown in FIG. 6, since the underline 164 printed last in the additional information area 162 is formed by printing a plurality of lines, which is so-called solid printing, the number of print dots for the last four lines is larger than the preset reference value 33.

Figure 7:
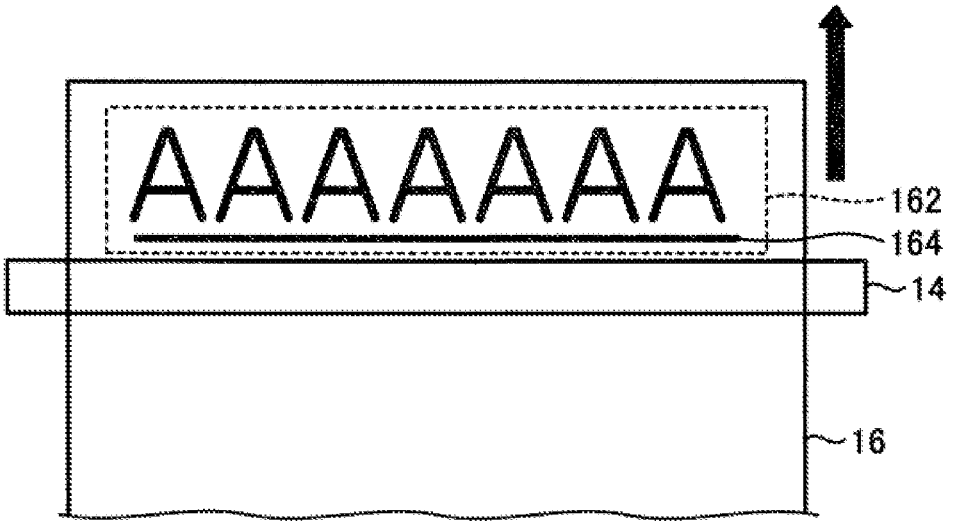
FIG. 7 is a diagram showing a positional relationship between a thermal head and a thermal paper after an additional feed by a thermal printer according to an embodiment.

Therefore, if the thermal head 14 stays on the last line of the underline 164, the thermal head 14 and the thermal paper 16 may stick to each other. In order to prevent the sticking, after the cutter 15 cuts the thermal paper 16, the conveyance control unit 206 controls the conveyance unit 18 to feed the thermal paper 16 by a predetermined amount in the arrow direction as shown in FIG. 7. When the number of print dots for the last four lines is not larger than the preset reference value 33, the heating element of the thermal head 14 and the thermal paper 16 are less likely to stick to each other, and thus additional feed is not performed. This is because the occurrence of jamming of the thermal paper 16 can be reduced by not performing unnecessary additional feed.

Figure 8:
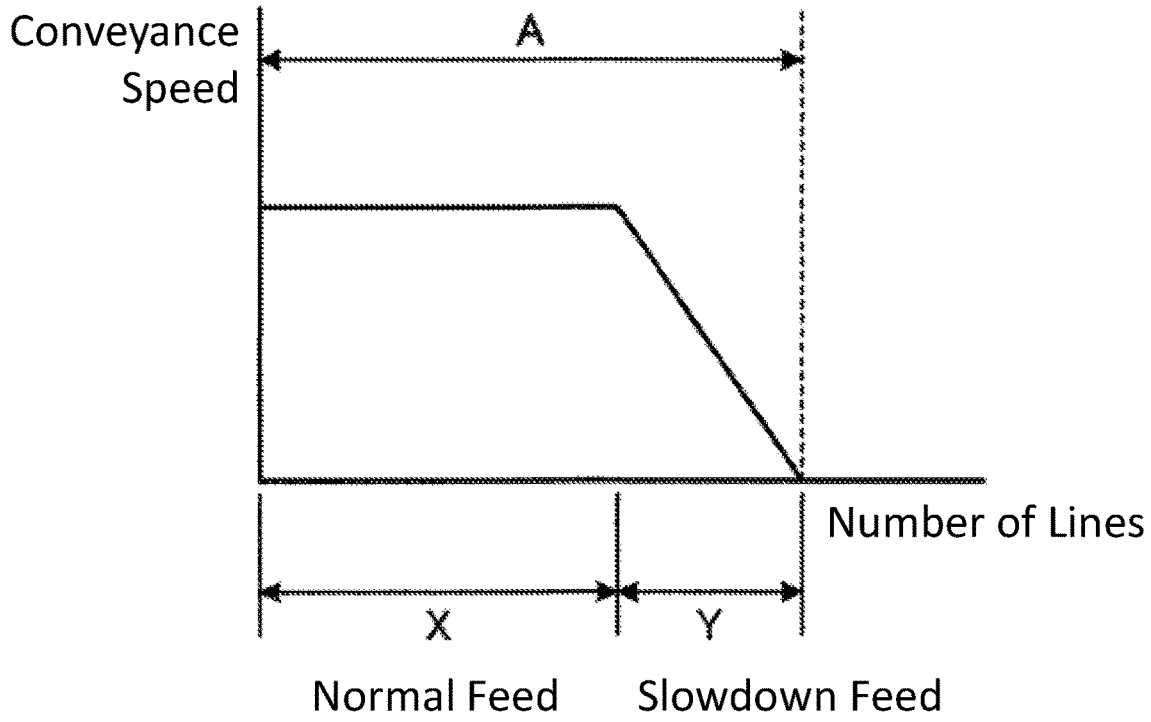
FIG. 8 is a diagram illustrating a conveyance speed of a conveyance motor when an additional feed is not performed in a thermal printer according to an embodiment.

Next, conveyance of the thermal paper 16 will be described. During printing, the thermal printer 1 repeats (a) printing of one line by the thermal head 14 and (b) conveyance of the thermal paper 16 by one line by the conveyance unit 18. FIG. 8 is a diagram showing the conveyance speed of the conveyance motor 17 when the above-described additional feeding is not performed.

In a printing period A from the first line to the last line in the print dot data, the thermal printer repeats the one-line printing and the one-line conveyance. In the printing period A, the conveyance in the printing of the last predetermined number of lines, for example, the last four lines, is made during the slowdown feed period Y, and the conveyance in the remaining numbers of lines is made during the normal feed period X.

The conveyance motor 17 is driven at a constant speed during the normal feed period X, and is driven at a speed gradually reduced from the constant speed during the slowdown feed period Y. By providing the slowdown feed period Y, it is possible to suppress the occurrence of slack or the like in the roll-shaped thermal paper 16 due to inertial force when the conveyance motor 17 is stopped. Therefore, it is possible to suppress a decrease in print quality caused by the slack of the thermal paper 16 or the like at the start of the next printing.

Figure 9:
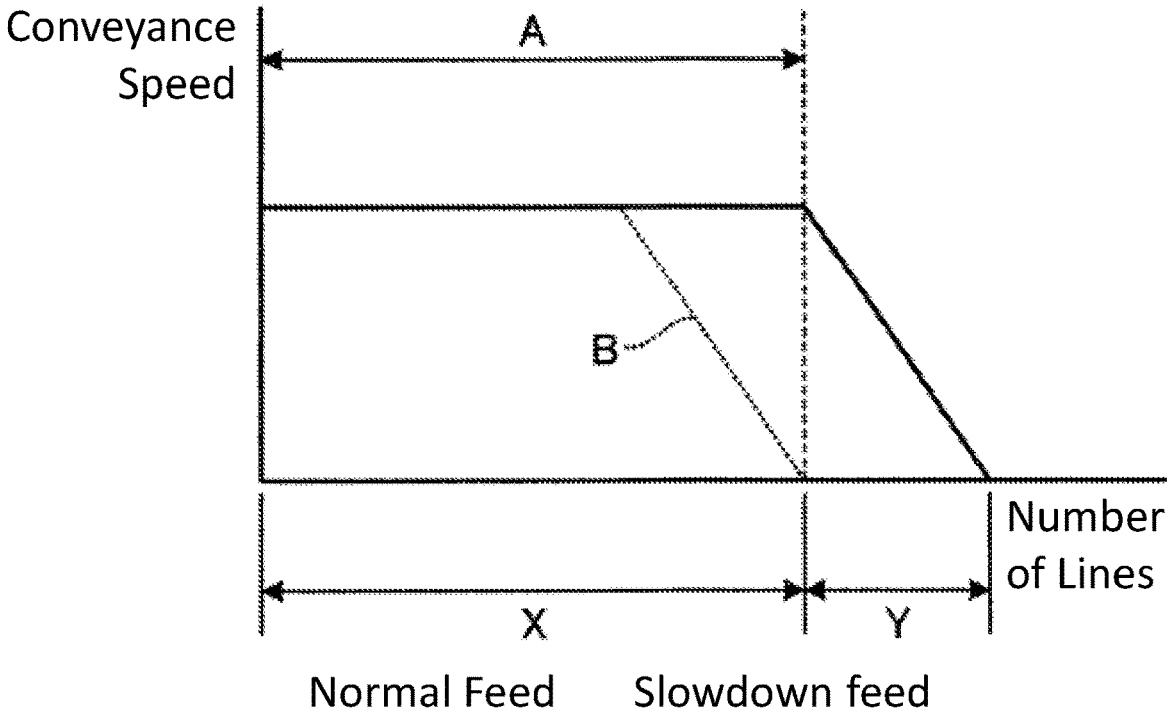
FIG. 9 is a diagram illustrating a conveyance speed of a conveyance motor when additional feed is performed in a thermal printer according to an embodiment.

FIG. 9 is a diagram showing the conveyance speed of the conveyance motor 17 when the above-described additional feed is performed. When the additional feeding is performed, the conveyance motor 17 is driven at a constant speed during the printing period A, and is driven at a gradually reduced speed during the additional feeding. In other words, the printing period A is the normal feed period X, and the additional feed period is the slowdown feed period Y. In this way, since the slowdown feed period Y and the additional feed period are made to coincide with each other, in other words, since the number of lines to be conveyed in a slowdown manner and the number of lines to be conveyed in the additional feed are made to coincide with each other, the conveyance speed does not decrease in the printing period A, and the print time can be shortened.

Figure 10:
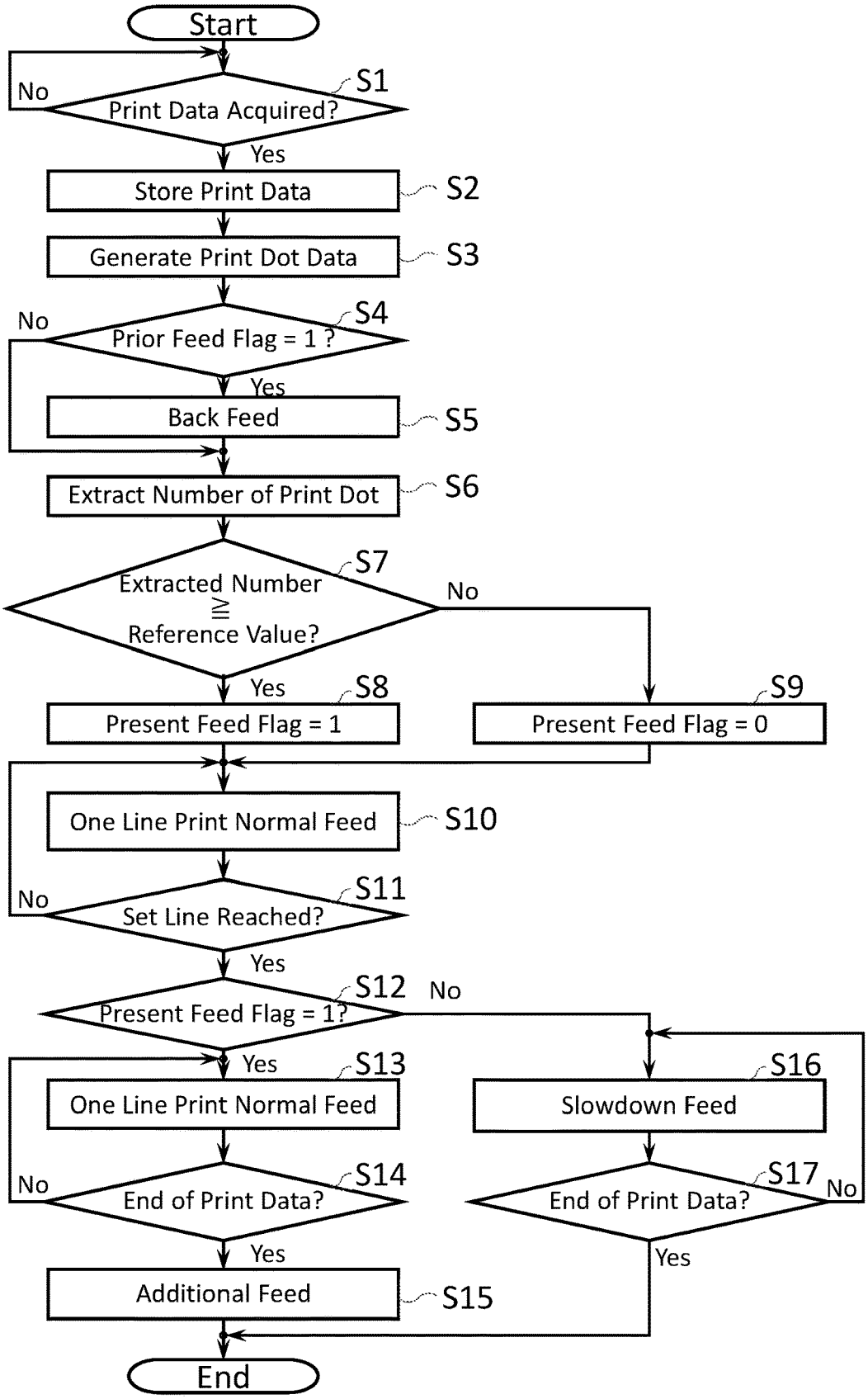
FIG. 10 is a flowchart showing a control process performed by a thermal printer according to an embodiment.

Next, a process carried out by the controller 20 will be described. FIG. 10 is a flowchart showing such a process carried out during printing.

First, the controller 20 determines whether the acquisition unit 201 has acquired print data from the POS terminal (S1). When the acquisition unit 201 has acquired the print data (Yes in S1), the acquisition unit 201 stores the print data in the print data section 32 (S2). The generation unit 202 reads the print data stored in the print data section 32, generates print dot data 231 in a bitmap format, and stores the print dot data 231 in the RAM 23 (S3). By this process, the generation unit 202 converts the incoming print data indicating the print image formed by a plurality of lines into the print dot data 231 indicating which particular heating elements generate heat for each line of the printing. When the acquisition unit 201 has not acquired the print data (No in S1), the controller 20 returns to the process in S1.

After the print dot data 231 is generated in S3, the controller 20 determines whether the feed flag is "1" for the prior job by reference to the additional feed information section 35 (S4). When "1" is stored as the feed flag for the prior job, the conveyance control unit 206 drives the conveyance motor 17 to feed the thermal paper 16 back (back feed) by a predetermined amount (S5). When the prior feed flag is "1", back feeding is performed by the predetermined amount in order to set the printing start position to a correct position in the current printing since an additional feed has been performed after the end of the previous printing. More specifically, in the example shown in FIGS. 6 and 7, the thermal paper 16 is fed back from the state shown in FIG. 7 in which additional feed has been performed in the previous printing, and then the state shown in FIG. 6 is obtained. The predetermined amount of back feed, that is, the length of back feed of the thermal paper 16 is the same as the length of the additional feed after the end of the previous printing. The length by which the thermal paper 16 is fed back may be longer than the length by which the thermal paper 16 is additionally fed after the previous printing. This is because it is also possible to start printing after feeding by an amount corresponding to the previous longer back feed.

Following the process of S5, the extraction unit 203 extracts the number of print dots of a predetermined number of lines including the last line from the print dot data 231 (S6). For example, the predetermined number of lines is four, and the extraction unit 203 extracts the number of print dots for the last four lines, that is, the number of heating elements that generate heat in printing the last four lines.

When the prior feed flag is not "1" in the process of S4 (No in S4), the controller 20 skips the process of S5 and proceeds directly to S6.

Next, the determination unit 204 reads the reference value 33 and determines whether the number of print dots extracted in S6 is equal to or greater than the reference value (stored in reference value section 33) (S7).

When the number of print dots extracted in S6 is equal to or larger than the reference value (Yes in S7), that is, when there is considered to be a high possibility that the heating elements of the thermal head 14 and the thermal paper 16 will stick to each other after printing of the print data, the determination unit 204 sets "1" in the present feed flag in the additional feed information section 35 (SB).

If the number of print dots extracted in S6 is not equal to or greater than the reference value (No in S7), that is, if the possibility of sticking between the heating elements of the thermal head 14 and the thermal paper 16 after printing is considered to be low, the determination unit 204 sets the present feed flag to "0" in the additional feed information section 35 (S9).

Subsequently, after the print control unit 207 controls the thermal head 14 to print one line, the conveyance control unit 206 controls the conveyance motor 17 to convey the thermal paper 16 by one line at the conveyance speed set in the normal feed period (S10). The process of S10 may be referred to as normal feed printing. Following the normal feed printing at S10, the controller 20 determines whether printing of the set lines has been performed (S11). Specifically, the controller 20 determines whether the number of lines for which printing has not yet been completed remaining for the print dot data 231 has reached the slowdown line number (stored in the slowdown line number section 34). In other words, the controller 20 determines whether the printing up to the line at which the slowdown would be started has been completed.

When the printing up to the set lines has not yet been performed in the process of S11 (No in S11), the controller 20 returns to the process of S10 and repeats the normal feed printing by the printing control unit 207 and the conveyance control unit 206. When the printing up to the set lines has been completed (Yes in S11), the additional feed check unit 205 determines whether the present feed flag stored in the additional feed information section 35 (in the process in S8 or S9) is set to "1" (S12).

When the present feed flag is "1" (Yes in S12), normal feed printing is performed by the print control unit 207 and the conveyance control unit 206 (S13) until the end of the print data. That is, when the present feed flag is "1", the normal feed printing is performed without performing the slowdown feed during the printing of the print dot data 231, but rather occurs after the completion of all the lines of the print dot data 231.

Next, the controller 20 determines whether printing of the print data acquired by the acquisition unit 201 has completed (S14), and if printing of the print data has not yet been completed (No in S14), the controller 20 returns to the process in S13 and repeats the normal feed printing by the print control unit 207 and the conveyance control unit 206. If the printing is completed (Yes in S14), the conveyance control unit 206 controls the conveyance motor 17 to perform an additional feed (S15), and ends the process. The additional feed is performed by a slowdown feeding in which the speed of the conveyance motor 17 is gradually reduced.

In the S12 process, when the feed flag is not "1" (No in S12), the print controller 207 controls the thermal head 14 to print the next line of the print dot data 231 and begin the slowdown feed process. Thus, the conveyance controller 206 controls the conveyance motor 17 to convey the thermal paper 16 at the conveyance speed set in the slowdown feed period (S16). Hereinafter, the process of S16 may be referred to as slowdown feed printing.

Next, the controller 20 determines whether printing of the print data has ended (S17), and if printing of the print data has not yet ended (No in S17), the controller 20 returns to the process in S16 and repeats slowdown feed printing process for another line of the print dot data. If the printing has been completed (Yes in S17), the process is terminated without performing any additional feed.

According to the thermal printer 1 of the above-described embodiments, when the number of print dots in the predetermined number of lines including the last line among the print dot data 231 generated by the generation unit 202 is equal to or greater than a set reference value (predetermined threshold value), the thermal paper 16 is additionally fed after the end of printing data. For this reason, even when the amount of heat generated by the thermal head 14 is large, it is possible to suppress sticking between the thermal head 14 and the thermal paper 16 because the thermal head 14 does not stay at the print position after completion of the printing. Therefore, it is possible to suppress a decrease in print quality due to conveyance unevenness of the thermal paper 16 caused by the sticking. In addition, the thermal printer 1 does not always perform additional feed after printing is completed. For example, in a situation in which the amount of heat generated by the thermal head 14 is relatively small and sticking is unlikely to occur, no additional feed is made after the completion of the printing. Therefore, unnecessary conveyance of the thermal paper 16 can be avoided, and the occurrence of jamming can be reduced.

Further, according to the thermal printer 1 of the aforementioned embodiments, the determination as to whether to perform additional feed is made using the number of print dots in a plurality of lines including the last line of the print data. Therefore, since the influence of the amount of heat generated in the previous printing of the final line can also be taken into consideration, it is possible to more accurately determine the possibility of sticking between the thermal head 14 and the thermal paper 16.

Furthermore, according to the thermal printer 1 of the aforementioned embodiments, when printing is performed, if additional feed has been performed in the previous printing, the thermal paper 16 is back-fed by the amount of the additional feeding before printing is started again. Therefore, the printing start position can be set to where it would be if as when the additional feed was not performed in the previous printing. Therefore, it is possible to unify the format of printed matter such as a receipt.

In addition, according to the thermal printer 1 of the aforementioned embodiments, when the additional feed is to be performed, the printing period A is set to be the normal feed period X, and the additional feed period is set to the slowdown feed period Y. In other words, the slowdown feed period Y and the additional feed period coincide with each other. Therefore, in the printing period A, the conveyance speed does not decrease, and the print time can be shortened.

In the above embodiments, the control programs executed by the thermal printer 1 may be copied from a non-transitory computer-readable recording medium such as a CD-ROM. The control programs executed by the thermal printer 1 according to the above embodiments may be downloaded via a network such as the Internet.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A thermal printer, comprising:

a conveyance unit configured to convey a sheet of thermal paper;

a thermal head including a plurality of heating elements arranged along a line crossing a conveyance direction of the sheet of thermal paper; and a controller configured to:

generate print dot data indicating one or more dots for each line to be printed on the sheet of thermal paper, control the conveyance unit to convey the sheet of thermal paper and the thermal head to print on the sheet of thermal paper according to the print dot data, determine whether a total number of dots to be printed in a predetermined number of consecutive lines including a last line of the print dot data is greater than or equal to a threshold number, and when the total number of dots is greater than or equal to the threshold number, control the conveyance unit to convey the sheet of thermal paper by a predetermined amount along the conveyance direction after printing of the print dot data is performed, wherein the controller is further configured to, when generating another print dot data:

determine whether the sheet of thermal paper has been conveyed by the predetermined amount after previous printing, and when the sheet of thermal paper has been conveyed by the predetermined amount after the previous printing, control the conveyance unit to convey the sheet of thermal paper along a direction opposite to the conveyance direction before printing on the sheet of thermal paper according to said another print dot data.

2. The thermal printer according to claim 1, wherein the controller is further configured to, if the total number of dots to be printed in the predetermined number of consecutive lines including the last line of the print dot data is less than the threshold number, control the conveyance unit to decrease a speed of conveyance of the sheet of thermal paper while the predetermined number of consecutive lines including the last line are being printed.

3. The thermal printer according to claim 1, wherein the controller is further configured to control the conveyance unit to maintain a speed of conveyance of the sheet of thermal paper during the printing of the print dot data if the total number of dots in the predetermined number of consecutive lines including the last line is greater than or equal to the threshold number.

4. The thermal printer according to claim 3, wherein the controller is further configured to control the conveyance unit to decrease the speed after the predetermined number of consecutive lines including the last line are printed if the total number of dots is greater than or equal to the threshold number.

5. The thermal printer according to claim 4, wherein after the printing of the predetermined number of consecutive lines including the last line, the sheet of thermal paper is conveyed by the predetermined amount with the decreased speed.

6. The thermal printer according to claim 5, wherein the speed is gradually decreased.

7. The thermal printer according to claim 1, further comprising:

a network interface configured to communicate with an external device, wherein the controller is further configured to generate the print dot data based on print data received from the external device via the network interface.

8. The thermal printer according to claim 1, further comprising:

a memory that stores a flag indicating whether the sheet of thermal paper has been conveyed by the predetermined amount after printing has been performed.

9. The thermal printer according to claim 1, further comprising:

a lower housing that stores a thermal paper roll comprising the sheet of thermal paper to be conveyed by the conveyance unit;

an upper housing that covers the thermal paper roll; and a port through which the printed sheet of thermal paper is dispensed.

10. A printing method carried out by a thermal printer, the method comprising:

generating print dot data indicating one or more dots for each line to be printed on a sheet of thermal paper;

controlling a conveyance unit to convey the sheet of thermal paper and a thermal head to print on the sheet of thermal paper based on the print dot data;

determining whether a total number of dots to be printed in a predetermined number of consecutive lines including a last line of the print dot data is greater than or equal to a threshold number; and controlling the conveyance unit to convey the sheet of thermal paper by a predetermined amount along the conveyance direction after the printing of the last line of the print dot data if the total number of dots is greater than or equal to the threshold number, wherein the method further comprises, when generating another print dot data:

determining whether the sheet of thermal paper has been conveyed by the predetermined amount after previous printing; and when the sheet of thermal paper has been conveyed by the predetermined amount after the previous printing, controlling the conveyance unit to convey the sheet of thermal paper along a direction opposite to the conveyance direction before printing on the sheet of thermal paper based on said another print dot data.

11. The method according to claim 10, further comprising:

if the total number of dots to be printed in the predetermined number of consecutive lines including the last line of the print dot data is less than the threshold number, controlling the conveyance unit to decrease a speed of conveyance of the sheet of thermal paper while the predetermined number of consecutive lines including the last line are being printed.

12. The method according to claim 10, further comprising:

if the total number of dots in the predetermined number of consecutive lines including the last line is greater than or equal to the threshold number, controlling the conveyance unit to maintain a speed of conveyance of the sheet of thermal paper during the printing of the print dot data.

13. The method according to claim 12, further comprising:

controlling the conveyance unit to decrease the speed after the predetermined number of consecutive lines including the last line are printed if the total number of dots is greater than or equal to the threshold number.

14. The method according to claim 13, wherein the conveyance of the sheet of thermal paper by the predetermined amount is made with the decreased speed.

15. The method according to claim 14, wherein the speed is gradually decreased.

16. The method according to claim 10, further comprising:

receiving print data from an external device via a network interface, wherein the print dot data is generated based on the received print data.

17. The method according to claim 10, further comprising:

storing a flag indicating whether the sheet of thermal paper has been conveyed by the predetermined amount after printing has been performed.

18. A non-transitory computer readable medium storing a program that when executed causes a thermal printer to perform a method comprising:

generating print dot data indicating one or more dots for each line to be printed on a sheet of thermal paper;

controlling a conveyance unit to convey the sheet of thermal paper and a thermal head to print on the sheet of thermal paper based on the print dot data;

determining whether a total number of dots to be printed in a predetermined number of consecutive lines including a last line of the print dot data is greater than or equal to a threshold number; and controlling the conveyance unit to convey the sheet of thermal paper by a predetermined amount along the conveyance direction after the printing of the last line of the print dot data if the total number of dots is greater than or equal to the threshold number, wherein the method further comprises, when generating another print dot data:

determining whether the sheet of thermal paper has been conveyed by the predetermined amount after previous printing; and when the sheet of thermal paper has been conveyed by the predetermined amount after the previous printing, controlling the conveyance unit to convey the sheet of thermal paper along a direction opposite to the conveyance direction before printing on the sheet of thermal paper based on said another print dot data.

* * * * *